United States Patent [19]

Larsen

[11] Patent Number: 4,745,782

[45] Date of Patent: May 24, 1988

[54] APPARATUS REMOVING FAT AND FLESH FROM THE FLESH SIDE OF A FUR

[75] Inventor: Bent J. Larsen, Outrup, Denmark

[73] Assignee: Granly Trykluft ApS, Esbjerg, Denmark

[21] Appl. No.: 920,149

[22] Filed: Oct. 16, 1986

[30] Foreign Application Priority Data

Feb. 20, 1986 [DK] Denmark ..... 782/86

[51] Int. Cl.[4] ..... C14B 1/04

[52] U.S. Cl. ..... 69/39; 69/40; 69/45

[58] Field of Search ..... 69/37, 39, 40, 42, 44, 69/45, 47

[56] References Cited

U.S. PATENT DOCUMENTS

| | | | |
|---|---|---|---|
| 2,504,219 | 4/1950 | Norden | 69/37 |
| 3,226,748 | 1/1966 | Godet | 69/39 X |
| 4,314,465 | 2/1982 | Reid | 69/40 |

FOREIGN PATENT DOCUMENTS

| | | | |
|---|---|---|---|
| 113795 | 9/1969 | Denmark | 69/37 |
| 1476840 | 3/1967 | France . | |
| 45-17911 | 6/1970 | Japan | 69/42 |

OTHER PUBLICATIONS

Translation of Danish Patent No. 113,795.

*Primary Examiner*—Wm. Carter Reynolds
*Attorney, Agent, or Firm*—Merchant, Gould, Smith, Edell, Welter & Schmidt

[57] ABSTRACT

An apparatus for removing fat and flesh from the flesh side of a fur comprises a mandrel with a tapered free end portion. The fur to be treated is arranged on the free end portion of the mandrel with its flesh side turned out and in a substantially stretched condition. The mandrel preferably has a polygonal, such as a rectangular, cross-section. The mandrel and the fur arranged thereon is moved in its longitudinal direction through a scraping device comprising oppositely arranged pairs of rollers having scraping edges which combined define a contour substantially complementary to the cross-sectional contour of the mandrel. Thus, the remnants of fat and flesh may be removed from the fur during a single advance stroke of movement of the mandrel in relation to the scraping device, and the treated fur may be stripped from the mandrel during a return stroke thereof.

28 Claims, 2 Drawing Sheets

APPARATUS REMOVING FAT AND FLESH FROM THE FLESH SIDE OF A FUR

BACKGROUND OF THE INVENTION

1. Field of the Invention

A fur which has been stripped from the dead body of a fur-bearing animal normally has layers or remnants of fat and/or flesh adhered to its flesh side. Such layers or remnants must be removed prior to further processing of the fur. The present invention relates to a method and apparatus for removing such undesired remnants of fat and/or flesh from the flesh side of a fur.

2. Description of the Prior Art

A known apparatus for removing remnants of fat and flesh from furs comprises a conical mandrel which is journalled at both ends so as to be rotatable about its longitudinal axis. A fur to be treated is arranged on the mandrel with the flesh side turned out. A scraping device, which is a single roller made from a resilient rubber material and which has its axis extending transversely to the axis of the mandrel, is rotated about its axis while pressed into engagement with the fur and moved along the length of the mandrel. The roller has three peripherally spaced straight scraping edges, which extend parallel to the axis of the roller, formed on its peripheral surface. Remnants of fat and flesh may be scraped from a narrow longitudinal zone of the fur by manually moving the rotating roller reciprocatingly along the mandrel, and from time to time the mandrel is rotated a certain angle for exposing another longitudinal zone of the fur for a scraping treatment. Such an apparatus is disclosed in Danish patent specification no. 113,795.

SUMMARY OF THE INVENTION

The present invention provides an improved method of removing fat and flesh from the flesh side of a fur, said method comprising arranging the fur with its flesh side turned out on an elongated supporting mandrel in a substantially stretched condition, and moving a scraping device having scraping edges which combined define a contour substantially complementary to the cross-sectional contour of the mandrel, and the mandrel in relation to each other in the longitudinal direction of the mandrel while maintaining scraping edges of the scraping device in engagement with the flesh side of the fur. Because the scraping edges of the scraping device define a contour, which is substantially complementary to the cross-sectional contour of the mandrel, i.e. of the fur arranged thereon in a substantially stretched condition, the flesh side of the fur may be freed from undesired remnants of fat and flesh by a single stroke of relative movement between the mandrel and the scraping device in the longitudinal direction of the mandrel, without any necessity of rotating the mandrel.

The fur may be fastened to the mandrel in a stretched condition in any suitable manner, and the mandrel may be supported at opposite ends, if desired. However, in order to facilitate the arrangement of the fur on and the removal of the fur from the mandrel, the fur may be arranged around a free, tapered end portion of the mandrel, and the scraping device may be moved in relation to the mandrel from its free end along the outer surface thereof. Because a fur stripped from a fur-bearing animal normally has a sleeve-like or bag-like shape, the arrangement of the fur on the mandrel may merely consist in pushing the sleeve-like fur around the tapered free end portion of the mandrel till the fur attains a sufficiently stretched condition.

In the preferred embodiment of the invention, the relative movement of the mandrel and the scraping device is a reciprocating movement through an advance stroke, in which scraping edges of the scraping device are pressed into resilient engagement with the flesh side of the fur, and through a return stroke in which the scraping edges of the scraping device is kept out of engagement with the fur. The engagement between the scraping device and the fur during the advance stroke tends to displace the fur in relation to the tapered end portion of the mandrel in a direction of increasing cross-sectional areas which tends to further stretch the fur.

The scraping device may be of any suitable type and may, for example, comprise blade-like scrapers which may be vibrated during use. In the preferred embodiment, however, the scraping device comprises rollers having scraping edges on their peripheral surfaces, and the contour (viewed in an axial plane) of the peripheral surface may then be complementary to the cross-sectional contour of the mandrel. As an example, the contour of the roller may define an arc of a circle when the cross-sections of the mandrel are circular. Alternatively, the mandrel may have a polygonal cross-section and in that case the scraping device may comprise a number of rollers corresponding to the number of sides of the polygon so that each of the rollers of the scraping device is adapted to cooperate with a side surface of the mandrel. The scraping edges on each roller then preferably define a substantially circular cylindrical or conical surface.

The rollers may be rotated so that the scraping edges, which are in engagement with the mandrel or fur, are moved in the same direction as the direction of the relative longitudinal movement of the mandrel and the scraping device, but possibly at a peripheral speed different from said relative movement. In the preferred embodiment of the method according to the invention, however, the rollers are rotated in a direction opposite to the relative longitudinal movement of the mandrel and the scraping device during said advance stroke, whereby an increased scraping action is obtained.

Furthermore, in the preferred embodiment of the method according to the invention, the tapered end portion of the mandrel has a substantially rectangular cross-section, and the tapered shape of the end portion is adapted to the shape of the fur to be treated, such as a mink fur.

The relative movement between the scraping device and the mandrel may be effected by either moving the scraping device and keeping the mandrel stationary, or by moving the mandrel as well as the scraping device. In the preferred embodiment, however, the scraping device is kept stationary while the mandrel is moved in relation thereto. When the fur arranged on the mandrel has passed the scraping device so that undesired remnants of fat and flesh have been removed therefrom, the fur may be gripped and held substantially immobile in relation to the scraping device during said return stroke, whereby the prepared fur is removed from the free end portion of the mandrel. The fur may, for example, be gripped by bristle-like means having their free ends in engagement with the fur and being directed so that they will function as barbs preventing the fur from following the mandrel during the return stroke.

The invention also provides an apparatus for removing fat and flesh from the flesh side of a fur, said apparatus comprising an elongated mandrel for supporting a fur therearound with its flesh side turned out, a scraping device including scraping edges which combined define a contour substantially complementary to the cross-sectional contour of the mandrel, means for biasing scraping edges of the scraping device into engagement with the flesh side of the fur arranged around the mandrel, and means for moving the mandrel and the scraping device in relation to each other in the longitudinal direction of the mandrel.

According to a further aspect the invention also relates to a roller for removing fat and flesh from the flesh side of a fur, said roller having a pair of opposite end surfaces, a peripheral surface extending therebetween and a plurality of peripherally spaced, elevated scraping edges substantially defining a surface of revolution and forming part of said peripheral surface, each scraping edge having a pair of end portions, which extend from respective free ends of the scraping edge located on substantially the same generatrix of the surface of revolution and adjacent to the respective end surfaces, and in the same peripheral direction in converging relationship towards a central edge portion interconnecting said pair of end portions. The roller is then preferably rotated in such direction that the free ends of each scraping edge will first come into engagement with the fur whereafter the points of contact between the scraping edge and the fur is displaced along the scraping edge towards the central edge portion therof. This causes that the fur is not only stretched in the longitudinal direction but also drawn in the transverse direction of the mandrel towards the central symmetry plane of the roller.

BRIEF DESCRIPTION OF THE DRAWINGS

The invention will now be further described with reference to the drawings, wherein.

DESCRIPTION OF THE PREFERRED EMBODIMENT

Figures 1, 4:
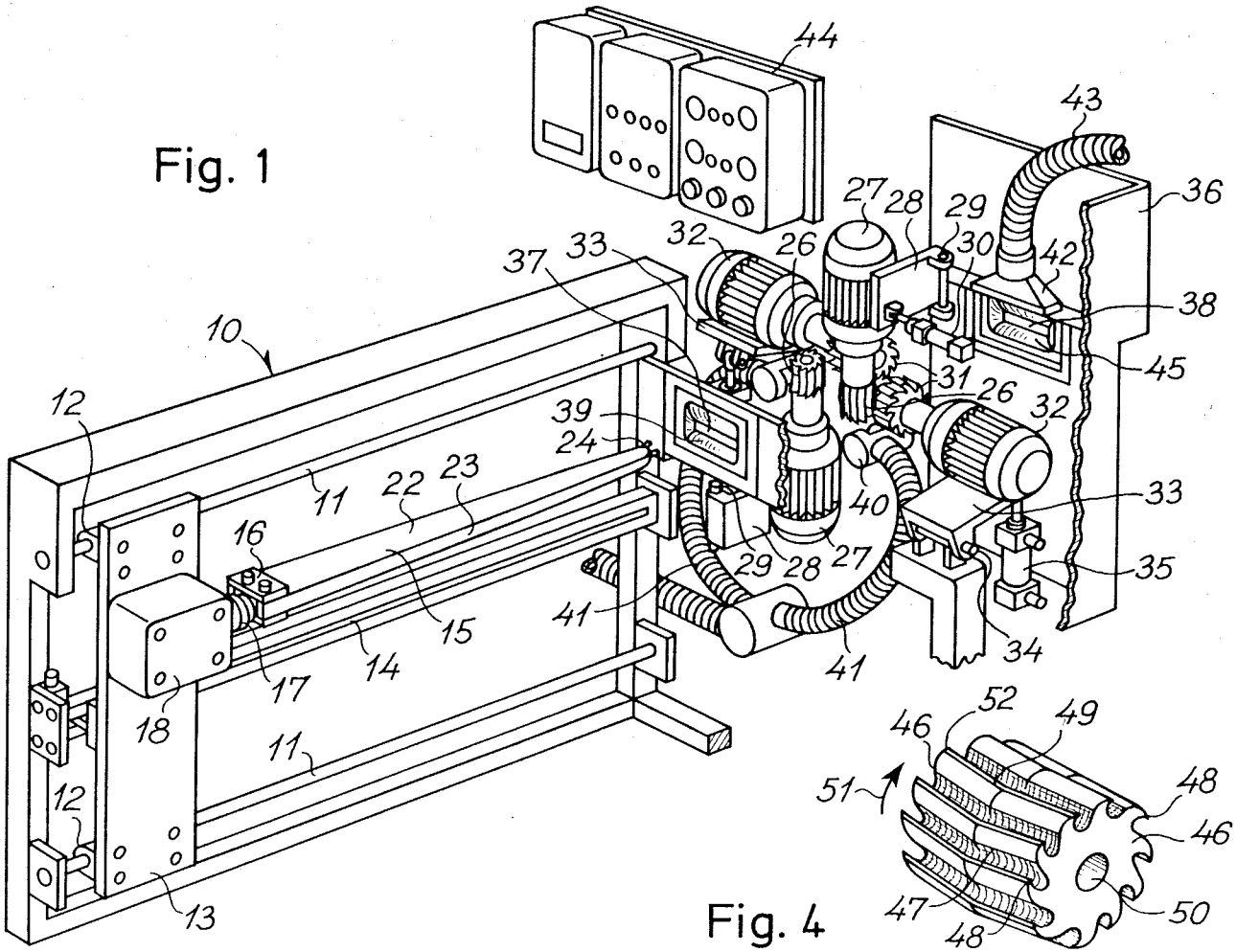
FIG. 1 is a perspective view of an embodiment of the apparatus according to the invention for treating furs of mink.
FIG. 4 is a perspective view of one of the scraping rollers used in the apparatus.
Figure 2:
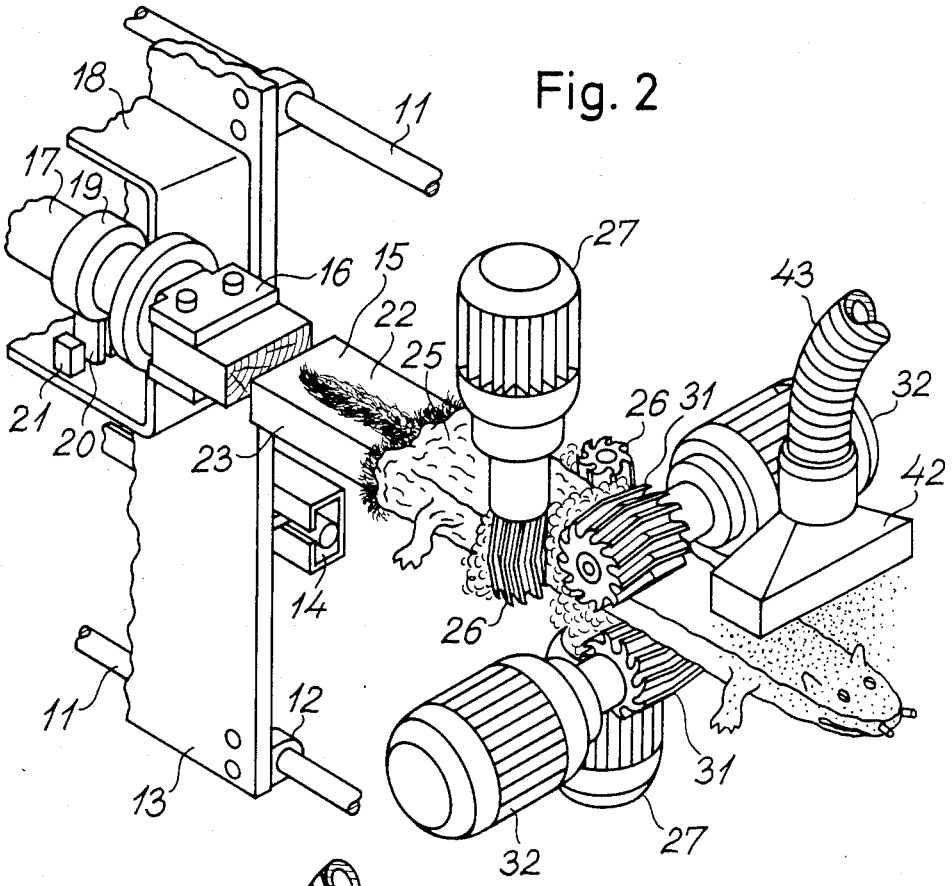
FIG. 2 is a perspective view of parts of the apparatus during an advance stroke of a mandrel on which a mink fur is arranged.
Figure 3:
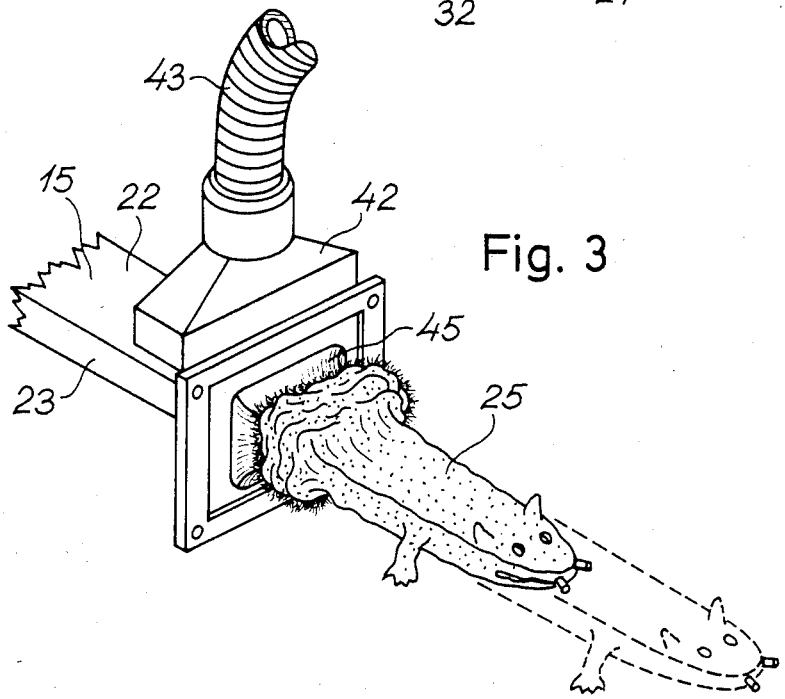
FIG. 3 illustrates how the treated mink fur is removed from the mandrel during its return stroke.

The apparatus shown in FIGS. 1-3 comprises a frame 10 having a pair of parallel, horizontally extending guiding rods 11. Sleeve members 12 encircling the guiding rods 11 are mounted on a carriage 13. The carriage 13 is also connected to the piston of a pneumatic cylinder 14 which is mounted on the frame 10 and extends parallel with the guiding rods 11, and which is of the type without a piston rod. One end of a mandrel 15, which is preferably made from wood, is bolted to a fork member 16 arranged on one end of a shaft 17, which is rotatably mounted within a bearing box 18 mounted on the carriage 13. A collar 19 mounted on the shaft 17 within the box 18 has a protrusion 20, which is arranged between a pair of spaced projections 21 formed on the inner side of the bottom wall of the bearing box 18, so as to restrict the rotatable movement of the shaft 17, and, consequently, of the mandrel 15 to a rather small angle. The mandrel 15 comprises a pair of upper and lower, substantially triangular surfaces 22 and a pair of opposite, substantially rectangular, narrow side surfaces 23. Not only the upper and lower surfaces 22, but also the side surfaces 23 are tapered towards the free end 24 of the mandrel 15. The size and shape of the free end portion of the mandrel 15 should be adapted to the size and shape of the furs 25 to be treated.

A scraping device comprises two pairs of rollers. Thus, a pair of oppositely arranged vertical rollers 26 driven by electric motors 27, each of which is mounted on a mounting plate 28 pivotally arranged about a pivot axis 29. The mounting plates 28 may be biased towards each other by means of pneumatic cylinders 30. Similarly, the scraping device also comprises a pair of oppositely arranged horizontal rollers 31 which are driven by electric motors 32, and the electric motors 32 are mounted on mounting plates 33 which may be pivoted in relation to the frame 10 about horizontally extending pivot axes 34. Pneumatic cylinders 35 actuating the mounting plates 33 may bias the horizontal rollers 31 towards each other. Apart from the swinging movements of the mounting plates 28 and 33, the scraping device comprising the two pair of rollers 26 and 31 is mounted stationarily in relation to the frame 10. As best shown in FIG. 2 the pairs of vertical and horizontal rollers 26, 31 are mutually spaced in the longitudinal direction of the mandrel 15, the vertical rollers 26 being positioned closer to the carriage 13 than the horizontal rollers 31.

The scraping device is surrounded by a casing 36 of which only part is shown in FIG. 1. This casing 36 comprises an entrance opening 37 and an exit opening 38. These openings, which are aligned with the mandrel 15, are at least partly covered by flexible shielding means 39 surrounding the openings 37 and 38. Suction nozzles 40, which are connected to a vacuum source (not shown) through vacuum conduits 41, are mounted below and adjacent to the pairs of rollers 26 and 31. The exit opening 38 passes through a dust chamber 42 to which saw dust or a similar substance may be supplied through a dust supply conduit 43.

The apparatus described above operates as follows:

When the mandrel 15 is in its retracted position shown in FIG. 1, a fur 25 is arranged on the free end portion of the mandrel with its inside or flesh side turned out. The operation of the apparatus is initiated by depressing a button of a control panel 44 which causes the pneumatic cylinder 14 to move the carriage 13 and the mandrel 15 with the fur 25 thereon through an advance stroke. During the advance stroke of the mandrel 15 the free end portion thereof with the fur 25 is passed through the entrance opening 37, and when the free end 24 of the mandrel 15 reaches the pair of vertical rollers 26, these rollers are rotated by the motors 27 in a direction so as to tend to counteract the advance movement of the mandrel, and at the same time the rollers 26 are pressed against the side surfaces 23 of the mandrel 15 by means of the pneumatic cylinders 30. The desired pressure of engagement may be selected by depressing a suitable button of the control panel 44. When the free end 24 of the mandrel 15 reaches the horizontal rollers 31, these rollers are also rotated by the motors 32 and pressed against the upper and lower surfaces 22 of the mandrel at a selected pressure by means of the pneumatic cylinders 35. The engagement between the rotating rollers and the flesh side of the fur arranged on the mandrel 15 causes removal of the remnants of flesh and fat from the flesh side of the fur, and the removed fat and flesh is sucked into the suction nozzles 40 and is currently removed from the apparatus through the vacuum conduits 41. Because the mandrel 15 is to some extent rotatable about its longitudinal axis, the rotational position of the mandrel may adapt itself to the position of the rollers 26 and 31.

When the treated fur passes through the dust chamber 42, the moist flesh side of the fur is coated with a layer of saw dust. The flexible shielding means 39 at the exit opening 38 may comprise stiff bristle-like members 45, which are to some extent directed in the direction of the advance stroke of the mandrel 15. Thus, these bristle-like members do not obstruct movement of the fur 25 through the exit opening 38 during the advance stroke of the mandrel 15. However, when the mandrel has reached an advanced position in which the free end portion of the mandrel having the fur 25 arranged thereon has passed through the exit opening 38, the advance stroke of the mandrel 15 is stopped. Now, the pneumatic cylinders 30 and 35 move the rollers 26 and 31 out of engagement with the fur 25, and the mandrel 15 is returned to its starting position shown in FIG. 1 by the piston of the cylinder 14, which is now driven in the opposite direction. During this return stroke of the mandrel 15, the bristle-like members 45 will engage with the scraped and dusted fur 25 like barbs, whereby the treated fur is stripped from the mandrel 15 as illustrated in FIG. 3. When the mandrel 15 has returned to the starting position shown in FIG. 1 it is ready to receive a further fur to be treated, and the operation described above may then be repeated.

As best shown in FIG. 4, each of the rollers 26 and 31 has opposite, substantially plane end surfaces 46 and a peripheral surface 47 extending therebetween. The peripheral surface 47 comprises a plurality of peripherally spaced teeth 48 having scraping edges 49 defining a substantially circular cylindrical surface. Each of the scraping edges 49 is substantially V-shaped and defines an obtuse angle. The vertices of the V-shaped scraping edges 49 are located in a symmetry plane extending at right angles to the axis of the roller. The roller has a cross-sectional contour similar to the contour of a circular saw and is provided with an axial bore 50 for receiving the driving shaft of a driving electric motor.

The roller, which is preferably made from rubber, plastics material, or a similar resilient material, is preferably rotated in the direction indicated by an arrow 51 in FIG. 4. This means that the fur being treated will first come into engagement with the free outer ends 52 of each scraping edge 49, and when the rotation of the roller proceeds, the two points of engagement of each scraping edge will moves towards the central symmetry plane of the roller. Consequently, the roller will tend to draw the fur towards this central plane. This in connection with the offset arrangement of two pairs of rollers 26 and 31 causes the remnants of fat and flesh to be removed also from the parts of the fur 25 located along the edges of the mandrel 15.

The rollers used in the apparatus shown in FIGS. 1–3 may have different diameters in the two pairs of rollers. Thus, in the embodiment shown in the drawings, the vertical rollers 26 cooperating with the side surfaces 23 of the mandrel 15 have a diameter which is substantially smaller than the diameter of the horizontal rollers 31 cooperating with the upper and lower surfaces 22 of the mandrel. The rollers are preferably mounted on the shafts of the electric motors 27 and 32 so that they may easily be released and replaced.

In the presently preferred embodiment, the horizontal rollers 31 have an axial length of 155 mm and the diameter of the circular cylindrical surface defined by the scraping edges 49 is 130 mm, the diameter of the axial bore 50 is 32 mm, the number of teeth 48 and scraping edges 49 is seven, and each of the V-shaped scraping edges defines an angle of 145°. Each of the vertical rollers 26 has a length of 85 mm, the diameter of the circular cylindrical surface defined by the scraping edges 49 is 65 mm, the diameter of the axial bore 50 is 17 mm, and the number of teeth 48 or scraping edges 49 is five, and each of the V-shaped edges 49 defines an angle of 175°.

It should be understood that various amendments and modifications of the embodiment shown in the drawings could be made without departing from the scope of the present invention. As an example, the mandrel 15 need not have a rectangular cross-section but it may have any other cross-sectional shape corresponding to the shape of the fur being treated. As an example, the mandrel may have a hexagonal cross-section, and the scraping device may then comprise three pairs of longitudinally offset rollers.

I claim:

1. An apparatus for removing fat and flesh from the flesh side of a fur, said apparatus comprising, an elongated mandrel for supporting a fur therearound with its flesh side turned out, a scraping device including scraping edges which define a contour substantially complementary to the cross-sectional contour of the mandrel, means for biasing scraping edges of the scraping device into engagement with the flesh side of the fur arranged around the mandrel, and moving means for moving the mandrel and the scraping device reciprocatingly in relation to each other through advance and return strokes, the biasing means being adapted to bias the scraping device into engagement with the flesh side of the fur only during the advance strokes of the relative movement.

2. An apparatus according to claim 1, wherein the mandrel has a tapered free end portion for receiving the fur thereon.

3. An apparatus according to claim 1, wherein said scraping device comprises rollers having peripheral surfaces on which the scraping edges are formed.

4. An apparatus according to claim 3, wherein the mandrel has a plurality of side surfaces and a substantially polygonal cross-section.

5. An apparatus according to claim 4, wherein said rollers are arranged in pairs, each pair engaging with opposite side surfaces of the mandrel, said pairs being arranged mutually offset in the longitudinal direction of the mandrel.

6. An apparatus according to claim 3, wherein at least one of the rollers has a pair of opposite end surfaces, a peripheral surface extending therebetween and a plurality of peripherally spaced, elevated scraping edges substantially defining a surface of revolution and forming part of said peripheral surface, each scraping edge having a pair of end portions, which extend from respective free ends of the scraping edge located on substantially the same generatrix of the surface of revolution and adjacent to the respective end surfaces, and in the same peripheral direction in converging relationship towards a central edge portion interconnecting said pair of end portions.

7. An apparatus according to claim 6, wherein the peripheral surface of the roller and the scraping edges defined thereon is substantialy symmetrical about a central symmetry plane.

8. An apparatus according to claim 7, wherein each scraping edge is substantially V-shaped.

9. An apparatus according to claim 8, wherein at least the parts of the rollers defining said peripheral surfaces are made from a resilient material.

10. An apparatus according to claim 9, wherein said resilient material is selected from the group consisting of rubber and plastics material.

11. An apparatus according to claim 4, wherein the mandrel is mounted rotatably about its longitudinal axis through a small angle.

12. An apparatus according to claim 1, further comprising a frame on which the scraping device is mounted, the moving means being adapted to move the mandrel longitudinally in relation to the scraping device.

13. An apparatus according to claim 1, further comprising a fur gripping device for gripping and substantially immobilizing the fur in relation to the scraping device during said return stroke so as to remove the fur from the mandrel.

14. An apparatus according to claim 1, further comprising a dust chamber arranged in the path of movement of a free end portion of the mandrel.

15. An apparatus according to claim 4, wherein the number of sides of the polygonal cross-section corresponds to the number of rollers of the scraping device, the rollers being adapted to cooperate with one of the side surfaces of the mandrel each.

16. An apparatus according to claim 15, wherein the mandrel has a rectangular cross-section while the scraping device comprises four rollers.

17. An apparatus according to claim 1, wherein the scraping edges of the scraping device define a substantially closed contour, whereby the scraping device may scrape substantially the total surface of the flesh side of the fur during the relative movement of the mandrel and the scraping device through a single advance stroke.

18. An apparatus for removing fat and flesh from the flesh side of a fur, said apparatus comprising, an elongated, substantially non-rotatable mandrel for supporting a fur with its flesh side turned out around a free end portion of the mandrel, a scraping device having scraping edges defining a substantially closed inner contour, which is substantially complementary to the cross-sectional contour of the mandrel, means for biasing the scraping edges defining the inner contour into engagement with the flesh side of the fur arranged around the free end of the mandrel, and means for reciprocatingly moving the mandrel and the scraping device in relation to each other in the longitudinal direction of the mandrel, whereby the scraping device may scrape substantially the total surface of the flesh side of the fur during the relative movement of the mandrel and the scraping device through a single stroke of said movement.

19. An apparatus according to claim 18, wherein said free end portion of the mandrel is tapered and has a plurality of side surfaces and a substantially polygonal cross-sectional shape.

20. An apparatus according to claim 19, wherein said scraping device comprises rollers having peripheral surfaces on which the scraping edges are formed.

21. An apparatus according to claim 20, wherein the number of sides of the polygonal cross-sectional shape corresponds to the number of rollers of the scraping device, the rollers being adapted to cooperate with one of the side surfaces of the mandrel each.

22. An apparatus according to claim 20, wherein said rollers are arranged in pairs, each pair engaging with opposite side surfaces of the mandrel, said pairs being arranged mutually offset in the longitudinal direction of the mandrel.

23. An apparatus according to claim 20, wherein at least one of the rollers has a pair of opposite end surfaces, a peripheral surface extending therebetween and a plurality of peripherally spaced, elevated scraping edges substantially defining a surface of revolution and forming part of said peripheral surface, each scraping edge having a pair of end portions, which extend from respective free ends of the scraping edge located on substantially the same generatrix of the surface of revolution and adjacent to the respective end surfaces, and in the same peripheral direction in converging relationship towards a central edge portion interconnecting said pair of end portions.

24. An apparatus according to claim 23, wherein the peripheral surface of the roller and the scraping edges defined thereon is substantially symmetrical about a central symmetry plane.

25. An apparatus according to claim 24, wherein each scraping edge is substantially V-shaped.

26. An apparatus according to claim 19, wherein the mandrel is rotatable about is longitudinal axis through a small angle.

27. An apparatus according to claim 18, wherein said biasing means comprise pneumatic cylinders.

28. An apparatus according to claim 18, further comprising a fur gripping device for gripping and substantially immobilizing the fur in relation to the scraping device during a return stroke of said reciprocating movement so as to remove the fur from the free end portion of the mandrel.

* * * * *